US005786837A

United States Patent [19]

Kaerts et al.

[11] Patent Number: 5,786,837

[45] Date of Patent: Jul. 28, 1998

[54] METHOD AND APPARATUS FOR THERMAL PRINTING WITH VOLTAGE-DROP COMPENSATION

[75] Inventors: Eric Kaerts, Melsele; Dirk Meeussen, Bornem, both of Belgium

[73] Assignee: Agfa-Gevaert N.V., Mortsel, Belgium

[21] Appl. No.: 554,856

[22] Filed: Nov. 7, 1995

[30] Foreign Application Priority Data

Nov. 29, 1994 [EP] European Pat. Off. ..... 94203465

[51] Int. Cl.[6] ..... B41J 2/36

[52] U.S. Cl. ..... 347/190; 347/188; 347/489

[58] Field of Search ..... 347/188, 190, 347/189, 191, 192; 400/120.09, 120.1, 120.11

[56] References Cited

U.S. PATENT DOCUMENTS 5,469,203 11/1995 Hauschild ..... 347/190

5,629,730 5/1997 Park ..... 347/188

*Primary Examiner*—Huan H. Tran

*Attorney, Agent, or Firm*—Baker & Botts, L.L.P.

[57] ABSTRACT

Thermal recording comprising the steps of supplying input data $I_u$ to a processing unit (23) of a printer having a thermal head with a plurality of heating elements; storing input data of a line into a buffer memory (24), further called input line data $I_l$; converting (25) the data $I_l$ into serial configurated data $I_s$; mapping (32) the data $I_s$ with resistance compensation data into power mapped data $I_m$; shifting the data $I_m$ into a shift buffer memory (26), further called shifted power mapped data $I_{m'}$; counting (33) a number $N_{s,on}$ of simultaneously activated heating elements; adapting (34) a strobe duty cycle δ (35) in accordance with $N_{s,on}$, further called voltage corrected strobe duty cycle $\delta_v$; providing (36) the $\delta_v$ and the data $I_{m'}$ to the heating elements for reproducing the line of an image.

8 Claims, 8 Drawing Sheets

| $\Delta t$ | $\Sigma$ "1" in | $H_i$ 1 | 2 | 3 | 4 | | $H_i$ 1 | 2 | 3 | 4 | | $H_i$ 1 | 2 | 3 | 4 | $\Sigma_{ts,on}$ out |
|---|---|---|---|---|---|---|---|---|---|---|---|---|---|---|---|---|
| 1 | 4 | 1 | 1 | 1 | 1 | | 1 | 1 | 1 | 1 | | 1 | 1 | 1 | 1 | 4 |
| 2 | 4 | 1 | 1 | 1 | 1 | $\oplus$ | 0 | 1 | 1 | 0 | = | 0 | 1 | 1 | 0 | 2 |
| 3 | 2 | 1 | 1 | 0 | 0 | | 1 | 1 | 0 | 1 | | 1 | 1 | 0 | 0 | 2 |
| 4 | 1 | 1 | 0 | 0 | 0 | | 0 | 1 | 1 | 0 | | 0 | 0 | 0 | 0 | 0 |
| | | $I_s$ | | | | | $R_p$ | | | | | $I_m$ | | | | |

METHOD AND APPARATUS FOR THERMAL PRINTING WITH VOLTAGE-DROP COMPENSATION

FIELD OF THE INVENTION

The present invention relates to thermal dye diffusion printing, further commonly referred to as sublimation printing, and more particularly to a method for correcting uneveness in the printed density of a thermal sublimation print.

BACKGROUND OF THE INVENTION

Thermal sublimation printing uses a dye transfer process, in which a carrier containing a dye is disposed between a receiver, such as a transparent film or a paper, and a print head formed of a plurality of individual heat producing elements which will be referred to as heating elements. The receiver is mounted on a rotatable drum. The carrier and the receiver are generally moved relative to the print head which is fixed. When a particular heating element is energised, it is heated and causes dye to transfer, e.g. by diffusion or sublimation, from the carrier to an image pixel (or "picture element") in the receiver. The density of the printed dye is a function of the temperature of the heating element and the time the carrier is heated. In other words, the heat delivered from the heating element to the carrier causes dye to transfer to the receiver to make thereon an image related to the amount of heat. Thermal dye transfer printer apparatus offer the advantage of true "continuous tone" dye density transfer. By varying the heat applied by each heating element to the carrier, an image pixel with a variable density is formed in the receiver.

However, in systems utilising this type of thermal printing, image artifacts through undesired variation in printed density are often observed. Such artifacts, called voltage drop effects, typically occur when in successive lines the number of activated heating elements changes and are perceived as lines with different densities. Voltage drop effects can be very disturbing if rectangular zones with a lower or higher density than the surroundings, like e.g. borders, are printed.

Voltage drop effects may be caused by the fact that the voltage V applied to the heating elements is not constant, and hence, as a result, the driven heating elements $H_i$ do not generate a constant quantity of heat.

U.S. Pat. No. 5,109,235 discloses a recorder wherein the number of pulses applied to the plurality of heating resistors in the thermal head is counted every gradation level and the applied pulse width (or the amplitude) is changed.

However, in a thermal recorder wherein the activating of the heating elements is executed "duty cycled pulsewise" and wherein a resistor compensation is carried out by "skipping" superfluous heating pulses, as described in U.S. patent applications Ser. Nos. 08/163,283 and 08/706,548 (assigned to Agfa-Gevaert), the method of U.S. Pat. No. 5,109,235 is not applicable.

OBJECTS OF THE INVENTION

It is therefore an object of the present invention to provide a method for printing an image at multiple gradations by thermal sublimation with a high printing quality maintained under all possible operating conditions.

More particularly, it is an object of the present invention to keep the power available to the heating elements of the thermal head constant during each strobe period, irrespective of a varying number of activated heating elements.

It is a further object of the present invention to provide also an apparatus for thermal recording with improved printing properties.

Further objects and advantages will become apparent from the description given hereinbelow.

SUMMARY OF THE INVENTION

We now have found that the above objects can be achieved by providing a method of thermal recording, comprising the steps of: providing a method for adjusting the thermal recording of a thermal printer, said thermal printer having a line-type thermal printing head with a plurality of heating elements, storage means for storing resistance compensation data associated with said plurality of heating elements, and a strobe generation means for repeatedly generating a strobe signal having predetermined cycles of repetition, said strobe signal having a first voltage during a first percentage of each cycle and a second voltage during a second percentage of each cycle, said plurality of heating elements being capable of being activated only while said strobe signal is at said first voltage, the method comprising the steps of:

a) supplying input data to said thermal printer, said input data representing a test pattern to be thermally recorded on a receiving medium, said test pattern comprising a first solid black area covering a first percentage of the width of said receiving medium and a second solid black area covering a second percentage of the width of said receiving medium, at least a portion of said first and second solid black areas covering different lines of said receiving medium;

b) converting said input data into power-mapped data using said resistance compensation data, said power-mapped data comprising one or more activation sequences for said plurality of heating elements;

c) for each of a predetermined number of cycles of said strobe signal, counting the number of said plurality of heating elements to be activated from said power-mapped data;

d) for each of said predetermined number of cycles of said strobe signal, adjusting said first percentage of each cycle for which said first voltage is generated in accordance with said number of heating elements to be activated;

e) for each of said predetermined number of cycles of said strobe signal, activating said plurality of heating elements in accordance with said power-mapped data and said strobe signal;

f) repeating steps (b) to (e) until said test pattern is printed on said receiving medium;

g) calculating a deviation between the printed density of said first solid black area and the printed density of said second solid black area of said test pattern printed on said receiving medium; and h) adjusting said first percentage of each cycle for which said first voltage is generated in accordance with said deviation.

Also provided is a method wherein all steps from step c onwards are repeated until several or all sublines of a line have been printed or until several or all lines of the image have been printed.

The present invention also provides an apparatus for printing an image by using the above described method for thermal recording.

Further preferred embodiments of the present invention are set forth in the detailed description given hereinafter.

DETAILED DESCRIPTION OF THE INVENTION

Hereinbelow the present invention will be clarified in detail with reference to the attached drawings, without the intention to limit the invention thereto.

Figure 1:
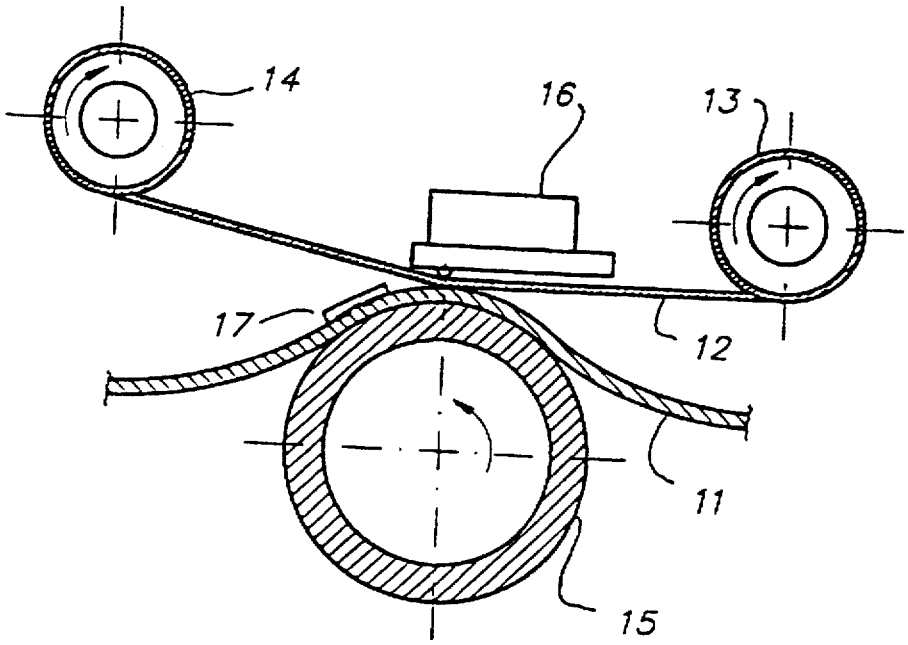
FIG. 1 is a principal scheme of a thermal sublimation printer.

Referring to FIG. 1, there is shown a global principal scheme of a thermal printing apparatus that can be used in accordance with the present invention and which is capable to print a line of pixels at a time on a receiver or acceptor member 11 from dyes transferred from a carrier or dye donor member 12. The receiver 11 is in the form of a sheet; the carrier 12 is in the form of a web and is driven from a supply roller 13 onto a take up roller 14. The receiver 11 is secured to a rotatable drum or platen 15, driven by a drive mechanism (not shown for purpose of simplicity) which advances the drum 15 and the receiver sheet 11 past a stationary thermal head 16. This head 16 presses the carrier 12 against the receiver 11 and receives the output of the driver circuits. The thermal head 16 normally includes a plurality of heating elements equal in number to the number of pixels in the image data present in a line memory. The imagewise heating of the dye donor element is performed on a line by line basis, with the heating resistors geometrically juxtaposed each along another and with gradual construction of the printed density. Each of these resistors is capable of being energised by heating pulses, the energy of which is controlled in accordance with the required density of the corresponding picture element. As the image input data have a higher value, the output energy increases and so the optical density of the hardcopy image 17 on the receiving sheet. On the contrary, lower density image data cause the heating energy to be decreased, giving a lighter picture 17.

Figure 2:
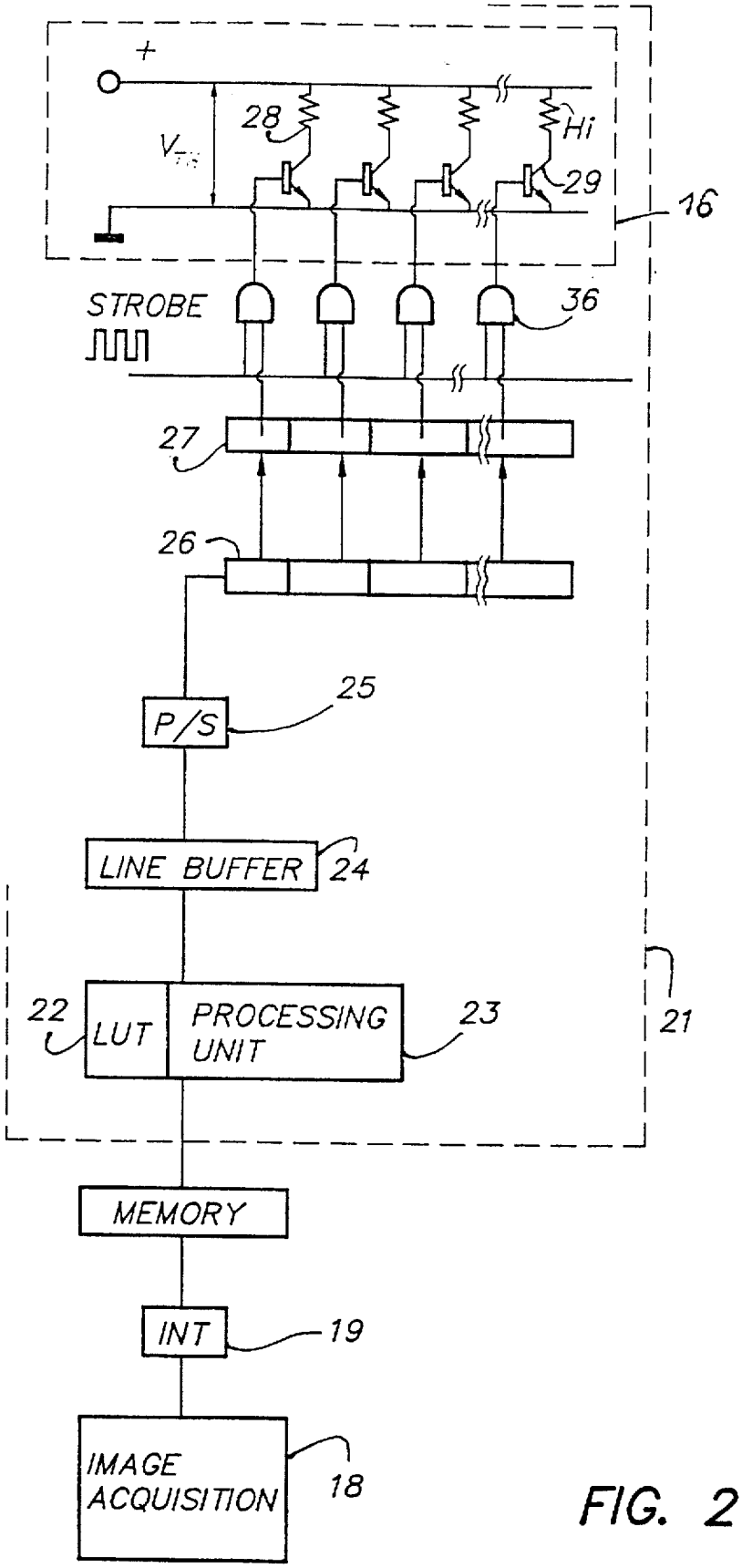
FIG. 2 is a data flow diagram of a thermal sublimation printer.

In the present invention, the activation of the heating elements is preferably executed pulsewise and preferably by digital electronics. The different processing steps up to the activation of said heating elements are illustrated in the diagram of FIG. 2. First a digital signal representation is obtained in an image acquisition apparatus 18. Then, the image signal is applied via a digital interface 19 and a first storing means (indicated as MEMORY in FIG. 2) to a recording unit 21, namely a thermal sublimation printer. In the recording unit 21 the digital image signal is processed 23 by a processing unit, which is explained more thoroughly in other patent applications as e.g. U.S. patent application Ser. No. 08/248,336 (assigned to Agfa-Gevaert).

Next the recording head (16) is controlled so as to produce in each pixel the density value corresponding with the processed digital image signal value. After processing (in 23) and parallel to serial conversion (in 25) of the digital image signals, a stream of serial data of bits is shifted into another storing means, e.g. a shift register 26, representing the next line of data that is to be printed. Thereafter, under controlled conditions, these bits are supplied in parallel to the associated inputs of a latch register 27. Once the bits of data from the shift register 26 are stored in the latch register 27, another line of bits can be sequentially clocked into said shift register 26. As to the heating elements 28, the upper terminals are connected to a positive voltage source (indicated as $V_{TH}$ in FIG. 2), while the lower terminals of the elements are respectively connected to the collectors of the driver transistors 29, whose emitters are grounded. These transistors 29 are selectively turned on by a high state signal applied to their bases and allow current to flow through their associated heating elements 28. In this way a thermal sublimation hardcopy of the electrical image data is recorded.

As already remarked in the description of the background, (in systems utilising this type of thermal printing) image artifacts by means of undesired variation in printed density are often observed. Such artifacts, called voltage drop effects, occur typically when in successive lines the number of activated heating elements changes.

The present invention offers an advantageous solution to this problem. First a general survey of all essential steps of the method of the present inventionwill be given, whereupon each step will be explained in full details.

Figure 12:
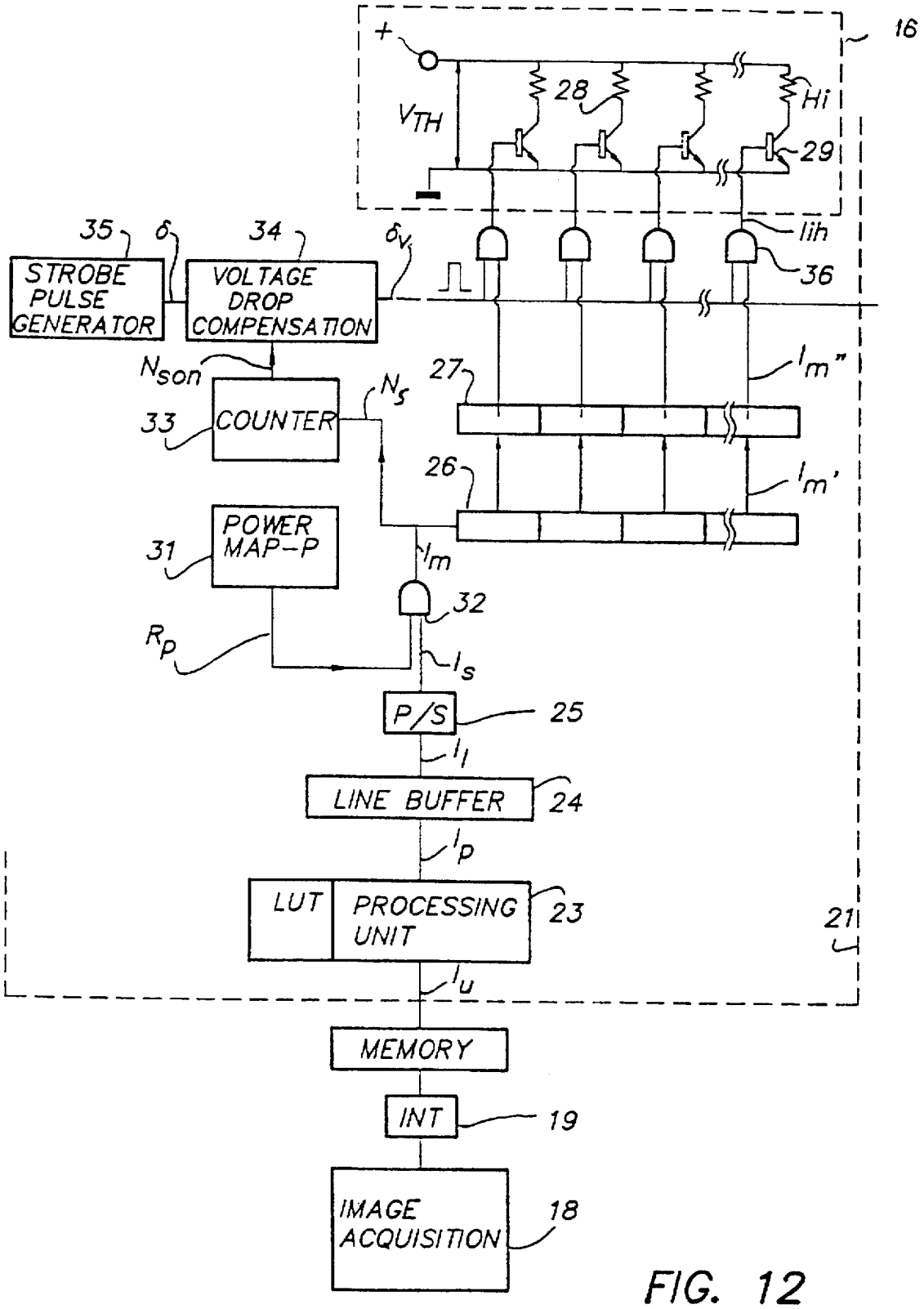
FIG. 12 is a data flow diagram of a preferred embodiment of a thermal sublimation printer according to the present invention.

With reference to FIG. 12, according to the present application, the method of thermal recording comprises the steps of:

a) supplying parallel formatted input data $I_u$ representing image information of an image to be recorded to a processing unit (23) of a thermal printer (21) having a line type thermal head (16) with a plurality of heating elements $H_i$ (28);

b) storing input data representing image information of one line of said image into a line buffer memory (24), the thus stored input data hereinafter called input line data $I_l$;

c) converting (25) said input line data $I_l$ into serial configurated data $I_s$; thereby created consecutive "time-slices" of said line of said image hereinafter being called "sublines";

e) mapping (32) for a subline the serial configurated data $I_s$ with resistance compensation data $R_p$ into so-called power mapped data $I_m$;

f) shifting said power mapped data $I_m$ into a shift buffer memory (26), the thus shifted data hereinafter called shifted power mapped data $I_m$, and meanwhile counting (33) a number $N_{s.on}$ of simultaneously activated heating elements;

g) adapting (34) a strobe duty cycle δ (35) in accordance with said number $N_{s,on}$, hereinafter called voltage corrected strobe duty cycle $\delta_v$;

h) providing (36) the voltage corrected strobe duty cycle $\delta_v$ and the shifted power mapped data $I_m$, to driving means (29) of the thermal head, thereby activating the heating elements (28) for reproducing said subline of the image.

The first step (a) of a method according to the present invention comprises the supplying of parallel formatted input data $I_u$ to a processing unit 23 of a thermal printer having a line type thermal head with a plurality of heating elements $H_i$ (28). As already mentioned before, the electrical image data are available at the input of processing unit 23. Said data are generally provided as binary pixel values, which are in proportion to the densities of the corresponding pixels in the image. For a good understanding of said proportion, it is noted that an image signal matrix is a two dimensional array of quantized density values or image data I(i,j) where i represents the pixel column location and j represents the pixel row location, or otherwise with i denoting the position across the head of the particular heating element and j denoting the line of the image to be printed. For example, an image with a 2880×2086 matrix will have 2880 columns and 2086 rows, thus 2880 pixels horizontally and 2086 pixels vertically. The content of said matrix is a number representing the density to be printed in each pixel, whereby the number of density values of each pixel to be reproduced is restricted by the number of bits per pixel. For a K bit deep image matrix, individual pixels can have $N=2^K$ density values, ranging from 0 to $2^K-1$. If the matrix depth or pixel depth is 8 bits, the image can have up to $2^8$ or 256 density values.

More in particular, the image signal matrix to be printed is preferably directed to an electronic lookup table 22 (abbreviated as LUT) which correlates the density to the number of pulses to be used to drive each heating element ($H_i$) in the thermal print head. This number will further be referred to as processed input data ($I_p$).

Of course, these pulses may be corrected by correlating each of the strings of pulses to density correcting methods. Also, these pulses may be processed such that an optimal diagnostic perceptibility is obtained, as described in U.S. Pat. No. 5,453,766 (assigned to Agfa-Gevaert). Thereafter, the processed pulses are directed to the head driver for energizing the thermal heating elements within the thermal head.

The second step (b) comprises a storing of processed input data $I_p$ representing image information of one line of the image, into a line buffer memory 24, whereafter said data are called "input line data $I_l$".

Figure 3:
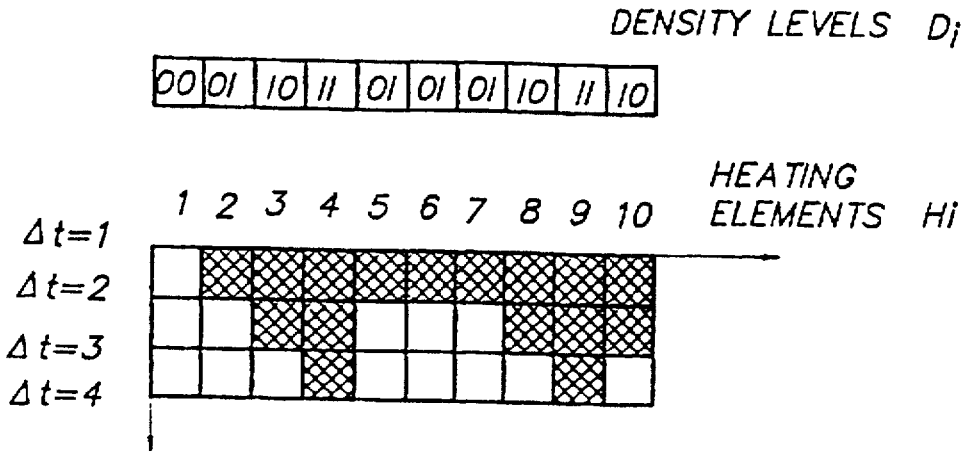
FIG. 3 is a graph illustrating the parallel to serial conversion of a ten-resistor-head subjected to image data of bytes consisting of two bits.
Figure 4:
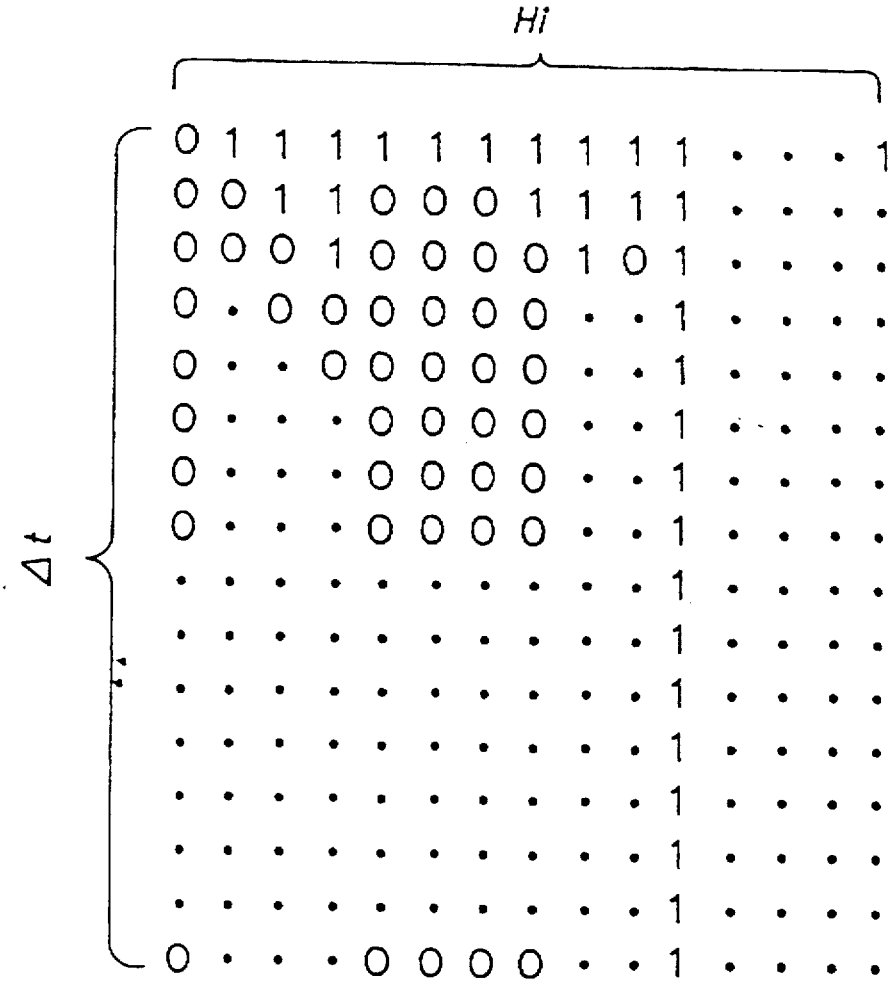
FIG. 4 is a graph illustrating serial formatted image data without skipping and representing multiple gradation levels.

At the input of the system, the electronical image data are mostly available (e.g. from a host computer) in a "parallel format" (e.g. bytes consisting of eigth bits), whereas the gradual construction (cfr. FIGS. 3 and 4, both to be explained further on) of a printed density on a receiver by thermal recording needs a (time-) "serial" format of the output drive signals.

Therefore, in a third step (c), a parallel-to-serial conversion of the input line data $I_l$, of which a preferred embodiment is described in U.S. Pat. No. 5,440,684 (assigned to Agfa-Gevaert), is also included in the present application. The serial formatted line data will be indicated by the symbol $I_s$.

Remembering the facts that the thermal head normally includes a plurality of heating elements equal in number to the number of pixels in the data present in the line memory and that each of the heating elements is capable of being energized by heating pulses, the number of which is controlled in accordance with the required density of the corresponding picture element. FIG. 3 illustrates the conversion of a ten-head-row subjected to image data of bytes consisting of two bits, and thus representing maximally four densities. It follows that the thermal head applied with a recording pulse causes current to flow through corresponding "ones" (cfr. input data indicative of "black picture elements") of the electrodes.

Integration of all (time-serial) heating pulses corresponding with consecutive gradation or density levels $d_i$ determines the total recording energy and thus the resulting printed density $D_i$. As the image input data are denser or higher, the output energy increases proportionally, thereby augmenting the optical density Di on the receiving sheet. On the contrary, lower density image data cause the output energy to be decreased, giving a lighter picture.

FIG. 4 is a graph illustrating serial formatted image data $I_s$ representing $2^K$ gradation levels $d_i$ as these data are available at the exit of the parallel to serial conversion means 25. By converting the input line data $I_l$ into serial configurated data $I_s$, subsequent "time-slices" are created, which further are called "sublines".

Before explaining the next step of the method of the present invention, it has to be emphasized that according to a preferred embodiment of the present invention, the activating of the heating elements is executed "duty cycled pulsewise". Such activating has already been described in U.S. patent applications Ser. Nos. 08/163,283 and 08/706,548, which are incorporated herein by reference; therefor, only a few characteristics are explained hereafter.

Figure 5:
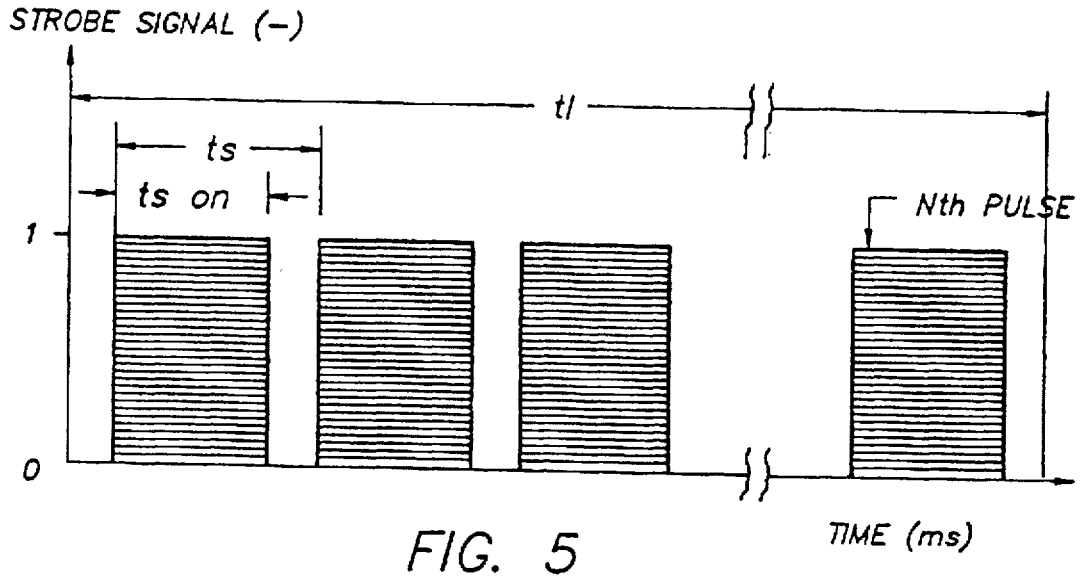
FIG. 5 is a chart illustrating for one heating element the activating heating pulses with an exemplary duty-cycle.

Duty cycled pulsing is indicated in FIG. 5, showing the current pulses applied to a single heating element (refs. $H_i$ and 28 in FIG. 2). The repetition strobe period ($t_s$) consists of one heating cycle ($t_{son}$) and one cooling cycle ($t_s-t_{son}$) as indicated in the same FIG. 5. The strobe pulse width ($t_{son}$) is the time an enable strobe signal is on. The strobe duty cycle of a heating element is the ratio of the pulse width ($t_{son}$) to the repetition strobe period ($t_s$). In a printer in connection with the present invention, the strobe period ($t_s$) preferably is a constant, but the pulse width ($t_{son}$) may be adjustable, according to a precise rule which will be explained later on; so the strobe duty cycle may be varied accordingly. Supposing that the maximal number of obtainable density values attains N levels, the line time ($t_l$) is divided in a number (N) of strobe pulses each with repetition strobe periods $t_s$ as indicated on FIG. 5. In the case of e.g. 1024 density values, according to a 10 bits format of the corresponding electrical image signal values, the maximal diffusion time would be reached after 1024 sequential strobe periods.

Still before explaining the next step of the present invention, it has to be emphasized that according to a preferred embodiment of the present invention, an equal time averaged power $P_{ave}$ is made available to the heating elements, although their individual characteristics, as resistance value and time delay in the switching circuit may be different. In the present application, by the term "an equal time averaged power $P_{ave}$" is understood that the power available to the heating elements of the thermal head is kept constant during each strobe period ($t_s$), meaning that the average value of the power during a heating time or strobe-on time ($t_{s,on}$) and during a cooling time or strobe-off time ($t_s-t_{s,on}$) is equal for all heating elements, irrespective of differences in resistance values etc. Indeed, it is known that there is normally variance in resistance value of the heating elements, which variance occurs when they are manufactured. The heating amount of the heating elements is changed by this variance and the printed density is thereby changed.

An advantageous solution to this problem has already been described in same said U.S. patent applications Ser. Nos. 08/163,283 and 08/706,548; therefore, only a few characteristics are explained hereafter.

As a result of this compensation step, an array of power corrections 31 (see FIG. 7) may be obtained, also referred to as "power map", to obtain power corrected image signals. This array gives for each heating element ($H_i$) the "power compensation data" $R_p$ intended for equidistant skipping of the strobe pulses. This thus guarantees an equal time averaged power available to the heating elements ($H_i$), although their individual characteristics, as resistance value (cfr. Ref. 28) and time delay in the switching circuit (cfr. Ref. 29), may be different.

Figure 6:
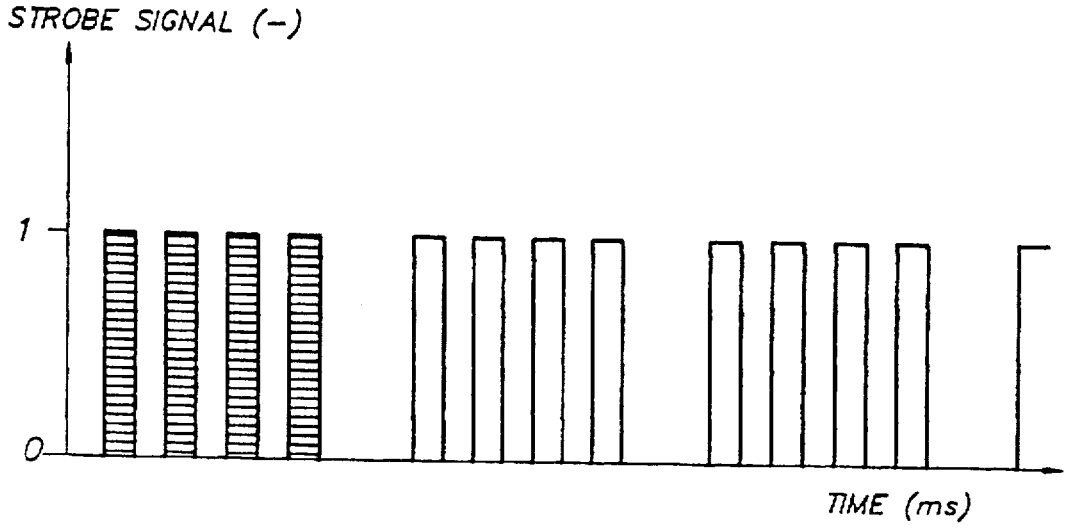
FIG. 6 is a chart illustrating for one heating element the activating heating pulses with an exemplary duty-cycle and with an exemplary skipping.
Figures 7, 8:
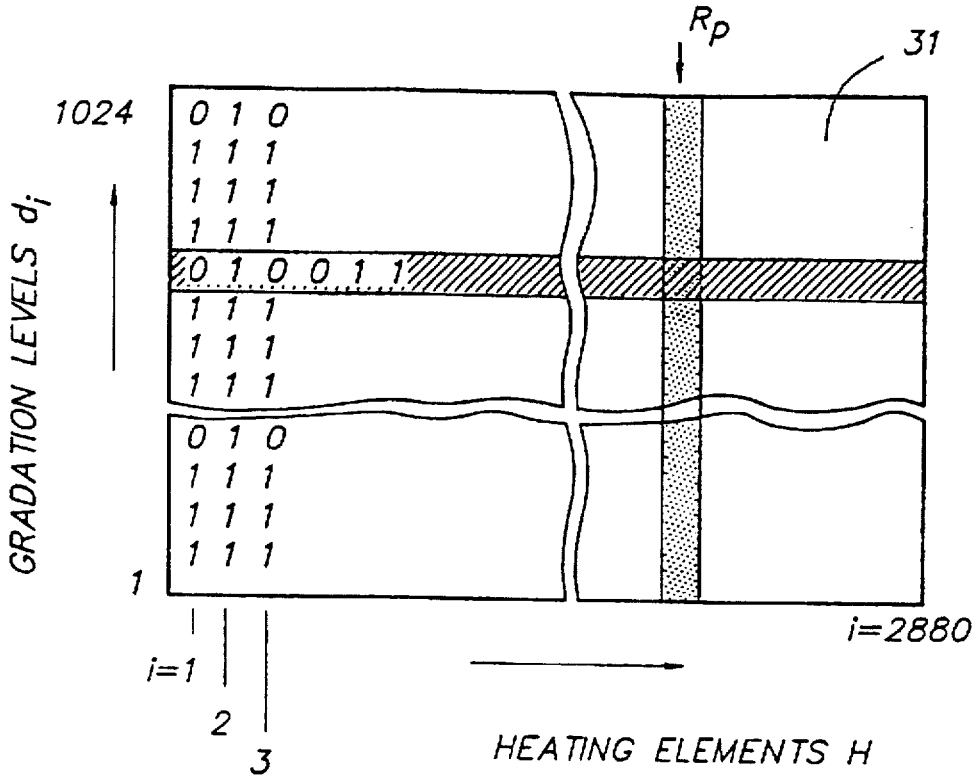
FIG. 7 is an array of resistance compensation data $R_p$ intended for equidistant skipping of strobe pulses, also referred to as power map.
FIG. 8 illustrates a mapping of serial configurated data $I_s$ with resistance compensation data $R_p$ into so-called power-mapped data $I_m$ according to the present invention.

Preferably, such power map 31 may be implemented in the form of a lookup table. Herein, for each heating element a power compensation $R_p$ is memorised, comprising pro each gradation or density level a row of binary 0's and 1's such that the heating element with the highest resistance and which, per consequence, could only dissipate a rather low power, is allowed to dissipate fully naturally. In the case of a 10 bit pixel depth, for this heating element, the power map will present a $R_p$ value consisting of 1024 times 1 (thus 111 . . . 111). For another heating element which normally would dissipate e.g. 25 percent of power above said reference, thus dissipating 125% $P_{ref}$, every fifth strobe pulse may be skipped as illustrated by FIG. 6; and hence, in the case of a 10 bit pixel depth, the power map will present a $R_p$ value 1111011110 . . . . All other heating elements will have $R_p$ values in between them, as e.g. 10101010 . . . . FIG. 7 is an array of power compensation data $R_p$ intended for equidistant skipping of strobe pulses and also referred to as "power map".

Now the next step (d) of the present invention, may be explained more clearly. According to the present invention, the fourth step (d) comprises a capturing (31) of resistance compensation data $R_p$ and a mapping (32) of the serial configurated data $I_s$ with said resistance compensation data $R_p$ into so-called "power mapped" data $I_m$.

A preferred embodiment for carrying out step (d) is shown in FIG. 8, which illustrates a mapping of serial configurated image-pixeldata with resistance compensation data into so-called power-mapped data according to the present invention.

Figure 9:
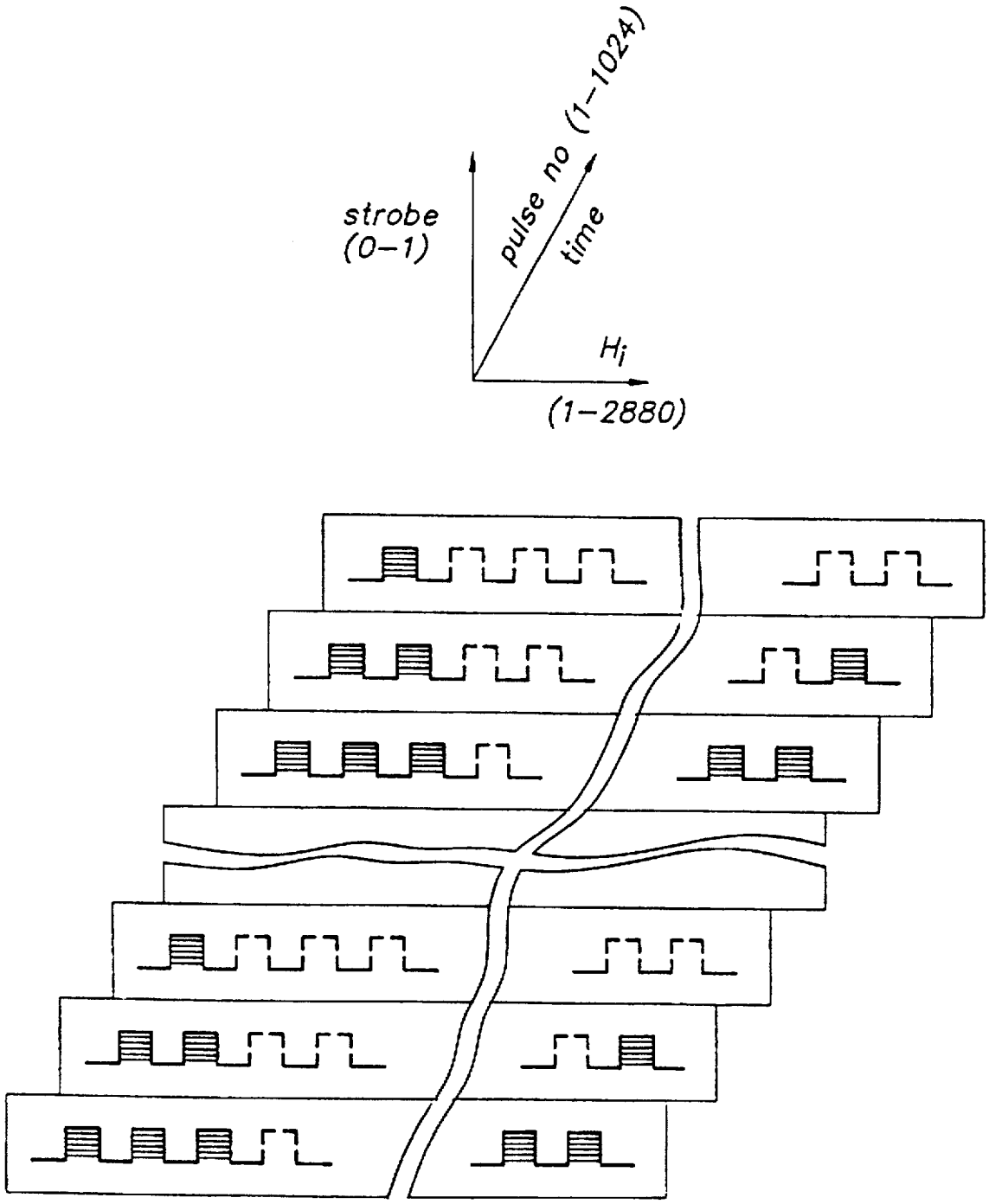
FIG. 9 is a chart illustrating for all heating elements the activating heating pulses with an exemplary duty-cycle and with an exemplary skipping.

As to the results of step (d), reference is made to FIG. 9, which is a chart illustrating for all heating elements the activating heating pulses with an exemplary duty-cycle and with an exemplary skipping. In FIG. 9, skipped pulses are indicated by dotted lines.

Per consequence of the foregoing steps, the power mapped data $I_m$ have been corrected for equal time averaged power, although individual characteristics of the heating elements may be different, as resistance value and time delay in the switching circuit. However, even after executing said power compensation of the heating elements of the thermal head some minor density differences still may rest in the print. First, e.g. because of further thermomechanical non-uniformities as e.g. variations in the mechanical or thermal contact between the thermal head and the back of the dye donor sheet, or variations in the thermal contact between the ceramic base of the head assembly and the heatsink, etc. A solution to this problem has been disclosed in patent application EP 94.201.310.3. Another possible reason which may cause such undesired variations precisely relates to the voltage-drop phenomen as indicated herabove.

A fifth step (e) in the method of the present application comprises a shifting of said power mapped data $I_m$ (further called shifted power mapped data $I_{m'}$) into a shift buffer memory 26 and meanwhile counting ( cfr. Ref. 33) a number $N_{s,on}$ of simultaneously activated heating elements.

A sixth step (f) in the method of the present application comprises an adapting (cfr. Ref. 34) of a strobe duty cycle $\delta$ (from generator 35) in accordance with said number $N_{s,on}$, further called "voltage corrected strobe duty cycle $\delta_v$".

In a next step (g), the voltage corrected strobe duty cycle $\delta_v$ and the shifted power mapped data $I_{m'}$ are provided via an AND-gate 36 to driving means 29 of the thermal head, thereby activating the heating elements 28 for reproducing the image.

Before explaining in greater depth the voltage drop compensation according to the present invention, one has to keep in mind at least the following facts. First, as the diffusion process for a pixel is a function of its temperature and of its transfertime, the printed density is a function of the applied energy (for a fixed time averaged power). Second, according to the present invention, the activation of the heating elements is preferably executed pulsewise, and thus the printed density has to be related to a time averaged power.

Figure 10:
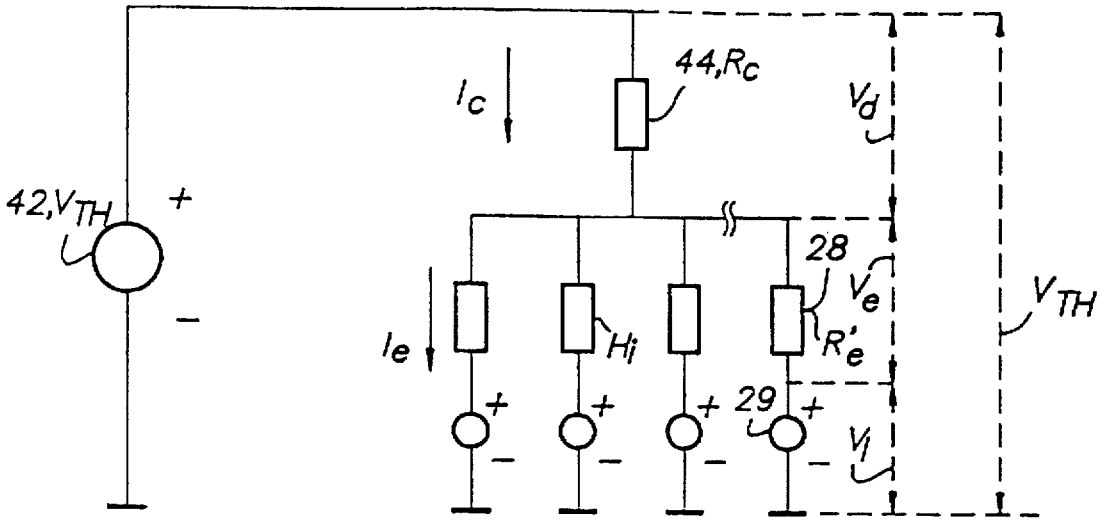
FIG. 10 is a circuit diagram of a thermal head showing components, currents and voltages.

In order to better understand the voltage drop phenomena, attention has to be paid to FIG. 10, which is a simplified circuit diagram of a thermal head showing components, currents and voltages, including heating elements Hi with resistance values $R_{e,i}$. [A more extended scheme has been disclosed in U.S. Pat. No. 5,664,893 (assigned to Agfa-Gevaert)]. The common wiring from the power supply 42 to the individual heating elements 28 inside the thermal head can be represented by a common resistance $R_C$ (Ref. 44). Further, $V_{TH}$ indicates the voltage of the power supply, $V_d$ indicates the voltage drop over the common wiring, $V_e$ indicates the voltage drop over the heating elements, $V_l$ indicates the voltage drop over the switching means (which itself is illustrated in FIGS. 2 and 12 by a transistor with referral 29), $I_c$ indicates the current through the common wiring and $I_e$ indicates the current through the heating elements.

From this FIG. 10, it may be easily understood that an electrical current through the heating elements of the thermal head causes a voltage drop over the wiring from the power supply to the heating elements inside the head. Because of the specific way of pulsewise activating according to the present invention (cfr. FIG. 5), this voltage drop happens during the strobe-on time $t_{s,on}$ and increases with the number $N_{s,on}$ of heating elements active at that moment. As a consequence, the dissipated power in the active heating elements, and therefore also the generated heat and the obtained density, depend on the number of activated heating elements. Evidently, the highest voltage drop is caused by the wiring common to all the elements, because the sum of all the electrical currents can flow through it.

Some practical experiences may be illustrated by following figures:

- the resistance value of the common wiring was tuned experimentally between 10 and 40 mΩ, often it amounted e.g. to $R_c \cong 24$ mΩ;
- the maximal voltage drop occuring if all heating elements were activated was found experimentally to be between 0.1 and 0.6 V, and amounted e.g. to $\Delta V_{max} \cong 0.35$;
- the maximal decrease in average power was found experimentally to be between 0.5 and 4.0 mW, e.g. $\Delta P_{max} \cong 2.7$ mW;

the maximal decrease in optical density was found experimentally to be between 0.1 D and 0.5 D, and amounted e.g. to $\Delta D \cong 20$ points for yellow Y, 22 points for magenta M and 35 points for cyan C.

Some relevant mathematical equations which control said voltage drop phenomen are as follows.

From FIGS. 5 and 10, it may be derived that the time averaged power dissipated in a heating element is given by $$P_{ave}=(V_e^2/R_e)\times(t_{s,on}/t_s) \quad [1]$$

wherein a voltage V applied to the heating elements is given by $$V_e=V_{TH}-V_l-V_d \quad [2]$$

and wherein the voltage drop over the common wiring is given by $$V_d=I_c\times R_c \quad [3]$$

or, in a more explicitated equation, by $$V_{drop}=N_{s,on}\times I_e R_{com} \quad [4]$$

According to the present invention, a solution to the voltage drop problem comprises a proportional increase of the active strobe time $t_{s,on}$ as the voltage $V_e$ over the heating elements decreases. More specifically: in every strobe period the average power during that strobe period is increased by stretching the $t_{son}$ of that strobe period and thus increasing the strobe duty cycle.

Technically, the number of active heating elements ($N_{son}$) is counted and the strobe-on time is compensated for voltage drop by:

$$t_{sonv}=\phi\{t_{son}, N_{son}, R_c, N_e, R_{par}) \quad [5]$$

wherein $t_{son}$ indicates an uncompensated strobe-on time, $N_{son}$ indicates the number of heating elements simultaneously active during this strobe-on time, $R_c$ indicates the resistance value of the common wiring resistance, $N_e$ indicates the total number of all heating elements, $R_{par}$ indicates a equivalent resistance value for all resistors in parallel.

Of course, it is understood that variations to the description of the present invention may be made in the form, details and arrangements, in order to conform to specific preferences or to specific applications. The following paragraphs are intended to illustrate some of such modifications.

First, it may be clear that all steps preferably are repeated until all sublines of a line of the image have been printed.

It also may be clear that all steps preferably are repeated until all lines of the image have been printed.

In a further preferred embodiment of the present invention, an intermediate step may be introduced, comprising a processing of the parallel formatted input data $I_u$, said data further being indicated by $I_p$.

Further, an intermediate step may be introduced, comprising bringing the shifted power mapped data $I_{m'}$ from a shift buffer memory (26) into a latching buffer memory (27), said data further being indicated by $I_{m''}$.

Next, the thermal recording is preferably carried out at least at two gradation (or density) levels.

In a next modification of the present invention, the counting of a number $N_{s,on}$ of simultaneously activated heating elements is carried out at each gradation level.

Next, the adapting of a strobe duty cycle $\delta$ is carried out at least at one gradation level.

Next, the adapting of a strobe duty cycle is carried out at a spaced number of gradation levels; e.g. each 8th gradation level.

Next, the adapting of a strobe duty cycle is carried out at each gradation level.

Next, the providing of the voltage corrected strobe duty cycle $\delta_v$ and the power mapped data $I_p$ is carried out at least at one gradation level.

Next, the providing of the voltage corrected strobe duty cycle and the power mapped data is carried out at a spaced number of gradation levels.

According to a further embodiment of the present invention, said providing of the voltage corrected strobe duty cycle and the power mapped data is carried out at each gradation level.

Within the scope of the present invention, there is also included a thermal printer comprising a thermal head having a plurality of heating elements, means for selectively activating each heating element, wherein said activating is executed pulse-wise with an adjustable strobe duty-cycle $\delta$, means for equalizing while printing the time averaged power $P_{ave}$ dissipated by each heating element; counting means (33) for counting a number $N_{s,on}$ of heating elements simultaneously activated at each gradation level $d_i$; and controlling means (34) for controlling the strobe duty-cycle at each gradation level in accordance with said number $N_{s,on}$ of heating elements counted by the counting means.

Figure 11:
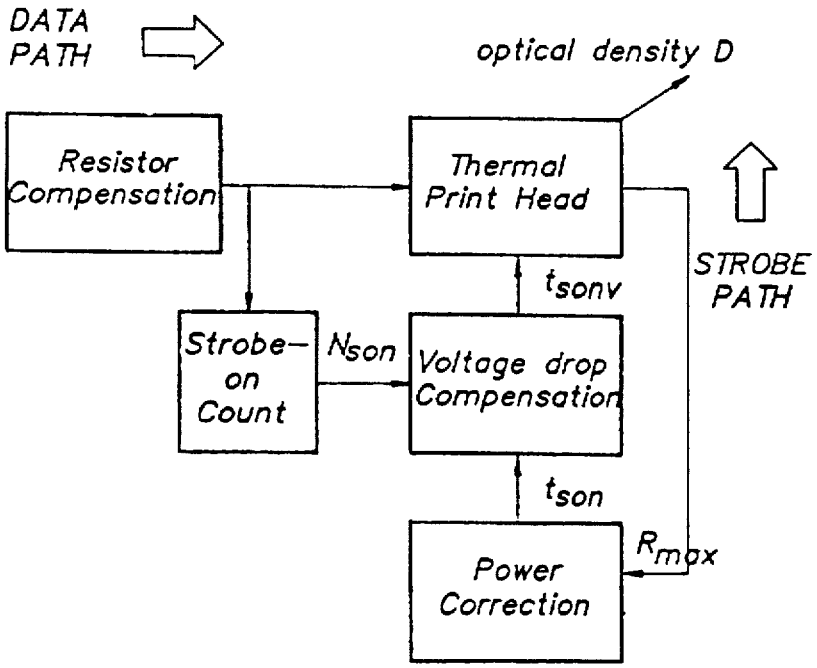
FIG. 11 is a partial block diagram of an activation of the heating elements in connection with a voltage drop compensation according to the present invention.

In order to clearly describe a preferred embodiment of the present invention, reference is made now to FIGS. 11 and 12. Herein FIG. 11 illustrates a partial block diagram of an activation of the heating elements in connection with a voltage drop compensation according to the present invention; and FIG. 12 illustrates a data flow diagram of a preferred embodiment of a thermal sublimation printer according to the present invention.

In response to the present invention, each heating element $H_i$ in a thermal head receives an electrical energization signal $I_{ih}$ that itself is a composite of two other electrical signals. Specifically, the energization signal is a logical AND (cfr. referral 36) of a voltage drop compensated strobe signal (from generator 35) and a power mapped data signal $I_{m''}$. The strobe signal, which is periodically sent to each of the heating elements consists of two portions, i.e. an initial on-time and a subsequent off-time (cfr. also FIG. 5). The data signal determines whether, within the period of the signal of the strobe signal, any portion of the strobe signal should be applied to a heating element to cause it to print.

For people skilled in the art, it may be clear that, in case that the input data would have already a serial format, of course any additional step of parallel to serial conversion is superfluous and hence the diagram of FIG. 12 may be simplified. In that situation, the method of the present invention can be reduced and comprises following steps:

a) supplying serial formatted input data to a processing unit of a thermal printer having a line type thermal head with a plurality of heating elements; as these serial formatted input data relate to consecutive time-slices of a line of image data, they also are called "sublines";

b) mapping said serial formatted input data with resistance compensation data into so-called power mapped data;

c) bringing said power mapped data into a shift buffer memory and meanwhile counting a number of simultaneously activated heating elements;

d) adapting a strobe duty cycle in accordance with said number, also called voltage corrected strobe duty cycle;

e) providing the voltage corrected strobe duty cycle and the power mapped data to the thermal head, thereby activating the heating elements for reproducing the image.

From another point of view, the diagram of FIG. 12 may in practice be often more complicated, in that it generally will be necessary to apply corrections to the image data before these data are used to obtain an image of high quality. Type and extent of corrections will also depend on the particular dye donor element being used. For example a different type of correction will generally be necessary when printing a black and white image using a black dye donor element than when a color image is being printed with a dye donor element having a series of differently colored dye frames. Other corrections may include differences in electrical characteristics of the heating elements and/or in physical characteristics of the contact between thermal head, donor element, receiver element and printing drum. An appropriate model is described in U.S. Pat. No. 5,664,893 (assigned to Agfa-Gevaert), and appropriate corrections are described in U.S. patent applications Ser. Nos. 08/163,283, 08/706,548, and 08/248,336.

In a still further preferred embodiment of the present invention, a method is implemented wherein the step of converting the input data into processed image data also comprises corrections as described in U.S. patent applications Ser. Nos. 08/163,283, 08/706,548, and 08/248,336.

Before a thermal recorder leaves the factory it undergoes a series of quality controls, which, amongst others, also check the voltage drop phenomena. The solution to this phenomena is then applied according to the disclosure of the present invention. Evidently, such check and said solution may be iterated, if and when necessary, during the lifetime of the thermal head.

Such control of a voltage drop phenomena preferably comprises a test pattern comprising solid "white" areas (which are not written at any density), alternated with solid "black" areas. These black areas preferably result from activating each heating element corresponding to that area with input image data, also called "power mapped input data $I_{i,m}$", so that a same time-averaged power is generated in each heating element to obtain a flat field area.

Giving a practical example of such test pattern, in a first zone A e.g. some 100 lines may be fully written over the total width of the receiver; then, in a zone B, some 100 lines with solid blacks over the first x % (say 25%) width and over the last y % (say also 25%) and solid white over the remaining (100-x-y) % (say 50%). Then, in a zone C, again e.g. some 100 lines may be fully written over the total width of the receiver; then, in a zone D, some 100 lines with solid blacks over the first x % (say 30%) width and over the last y % (say also 30%) and solid white over the remaining (100-x-y) % (say 40%); etc.

Thereafter, the results of the printed test pattern are evaluated by estimating the deviation of the printed density in a total black area (as zones A and C) versus the printed density in a partly black area (as zones B and D).

According to the results of said estimating, a solution to the voltage drop problem comprises an empirical increase or decrease of the active strobe time $t_{s,on}$ until the printed densitiy in zones A, B, C and D are all equal.

According to the present invention, since the amount of energy supplied to the heating elements is controlled in accordance with the number of active heating elements, there is no reduction in the recording quality, such as irregularities in the density within a line. As the method of the present invention provides a remarkable evenness in the printed density, said method is very well suited to be used in medical diagnosis. Further, the printing may be applied in graphic representations, in facsimile transmission of documents etc.

This invention may be used for greyscale thermal sublimation printing as well as for color thermal sublimation printing. In the case of color images, a set of color selection image input data $I_u$, representing yellow, magenta, cyan and black color components of the original color image, respectively are captured. Then, the electrical signals corresponding to the different color selections are processed. The color component signals are supplied to respective gradation correction circuits, in which gradation curves suitable for correcting the respective gradations for the yellow, magenta, cyan and black components are stored; preferably said signals are subjected to typical corresponding transformation lookup tables (LUT's).

It is, of course, understood that variations may be made in the form, details and arrangements of the various embodiments of the present description, in order to conform to design preferences or to the requirements of each specific application of this invention. The following claims are intended to cover all such variations or modifications of the illustrated embodiments as will readily occur to one skilled in the art.

It goes without saying that the present invention can be implemented for a thermal printer apparatus of other systems such as a heat transfer recorder using e.g. an resistive ribbon printing, using thermal wax printing or using direct thermal printing.

In addition, although a line type thermal head having a unidimensional arrangement has been described by way of example, the technique of the present invention may also be applied to an apparatus employing two-dimensionally arranged heating elements.

We claim:

1. A method for adjusting the thermal recording of a thermal printer, said thermal printer having a line-type thermal printing head with a plurality of heating elements, storage means for storing resistance compensation data associated with said plurality of heating elements, and a strobe generation means for repeatedly generating a strobe signal having predetermined cycles of repetition, said strobe signal having a first voltage during a first percentage of each cycle and a second voltage during a second percentage of each cycle, said plurality of heating elements being capable of being activated only while said strobe signal is at said first voltage, the method comprising the steps of:

a) supplying input data to said thermal printer, said input data representing a test pattern to be thermally recorded on a receiving medium, said test pattern comprising a first solid black area covering a first percentage of the width of said receiving medium and a second solid black area covering a second percentage of the width of said receiving medium, at least a portion of said first and second solid black areas covering different lines of said receiving medium;

b) converting said input data into power-mapped data using said resistance compensation data, said power-mapped data comprising one or more activation sequences for said plurality of heating elements;

c) for each of a predetermined number of cycles of said strobe signal, counting the number of said plurality of heating elements to be activated from said power-mapped data;

d) for each of said predetermined number of cycles of said strobe signal, adjusting said first percentage of each cycle for which said first voltage is generated in accordance with said number of heating elements to be activated;

e) for each of said predetermined number of cycles of said strobe signal, activating said plurality of heating elements in accordance with said power-mapped data and said strobe signal;

f) repeating steps (b) to (e) until said test pattern is printed on said receiving medium;

g) calculating a deviation between the printed density of said first solid black area and the printed density of said second solid black area of said test pattern printed on said receiving medium; and h) adjusting said first percentage of each cycle for which said first voltage is generated in accordance with said deviation.

2. A method for adjusting the thermal recording of a thermal printer, said thermal printer having a line-type thermal printing head with a plurality of heating elements, storage means for storing resistance compensation data $R_p$ associated with said plurality of heating elements, a strobe generation means for repeatedly generating a strobe signal having predetermined cycles of repetition, said strobe signal having a first voltage during a first percentage of each cycle and a second voltage during a second percentage of each cycle, and gated driving means for allowing the activation of said plurality of heating elements while said strobe signal is at said first voltage and prohibiting the activation of said plurality of heating elements while said strobe signal is at said second voltage, the method comprising the steps of:

a) supplying input data to said thermal printer, said input data representing a test pattern to be thermally recorded on a receiving medium, said test pattern comprising a first solid black area covering a first percentage of the width of said receiving medium and a second solid black area covering a second percentage of the width of said receiving medium, at least a portion of said first and second solid black areas covering different lines of said receiving medium;

b) storing a portion of said input data in a line buffer memory, said portion of said input data representing one line of said test pattern to be printed on said receiving medium;

c) converting said portion of said input data into serial configured data $I_s$, said serial configured data $I_s$ comprising one or more activation sequences for said plurality of heating elements;

d) converting said serial configured data $I_s$ into power-mapped data $I_m$ using said resistance compensation data $R_p$, said power-mapped data $I_m$ comprising one or more power-mapped activation sequences for said plurality of heating elements;

e) for each of a predetermined number of cycles of said strobe signal, consecutively shifting each power-mapped activation sequence of said power-mapped data $I_m$ into a shift buffer memory;

f) for each power-mapped activation sequence, counting the number of said plurality of heating elements to be activated from each sequence;

g) for each of said predetermined number of cycles of said strobe signal, adjusting said first percentage of each cycle for which said first voltage is generated in accordance with said number of heating elements to be activated;

h) for each of said predetermined number of cycles of said strobe signal, providing said shifted power-mapped activation sequence to said gated driving means;

i) for each of said predetermined number of cycles of said strobe signal, activating said plurality of heating elements in accordance with said shifted power-mapped data and said strobe signal;

j) repeating steps (b) to (j) until said test pattern is printed on said receiving medium;

k) calculating a deviation between the printed density of said first solid black area with the printed density of said second solid black area of said test pattern printed on said receiving medium; and l) adjusting said first percentage of each cycle for which said first voltage is generated in accordance with said deviation.

3. The method according to claim 1 or 2, wherein said input data comprises color data, and further comprising the step of processing said input data by color gradation correction circuits after the step of supplying input data to said thermal printer.

4. The method according to claim 2, further comprising the step of latching said shifted power-mapped activation sequence of said power-mapped data $I_m$ into a latching buffer memory, after step (e).

5. The method according to claim 1 or 2, wherein said input data and said power-mapped data have at least two gradation levels.

6. The method according to claim 1 or 2, where said predetermined number of cycles for said strobe signal is one.

7. The method according to claim 1 or 2, wherein a terminal of each of said heating elements is connected to a common node and said common node is electrically coupled to a power source, and wherein said step of adjusting said first percentage of each cycle for which said first voltage is generated in accordance with said number of heating elements to be activated ($N_{son}$) further comprises adjusting said first percentage of each cycle in accordance with the unadjusted value of said first percentage of each cycle ($t_{son}$), the resistance between said common node and said power source ($R_c$), the total number of said heating elements ($N_e$), and an equivalent resistance value for resistive elements in said thermal printing head ($R_{par}$).

8. The method according to claim 1 or 2, wherein said thermal recording is performed by thermal sublimation.

* * * * *